United States Patent [19]

Holloway

[11] 4,223,428

[45] Sep. 23, 1980

[54] METHOD AND APPARATUS FOR SECURING A FERROELECTRIC STACK TO A WEIGHTED PROJECTION SURFACE

[75] Inventor: Jack W. Holloway, Chula Vista, Calif.

[73] Assignee: The United States of America as represented by the Secretary of the Navy, Washington, D.C.

[21] Appl. No.: 375,570

[22] Filed: Jul. 2, 1973

Related U.S. Application Data

[62] Division of Ser. No. 201,706, Nov. 24, 1971.

[51] Int. Cl.[3] ..... H04R 17/00

[52] U.S. Cl. ..... 29/25.35; 367/158; 367/165; 367/173

[58] Field of Search ..... 340/8-14; 29/25.35; 310/8.7, 328; 156/289, 329; 367/157, 158, 165, 173

[56] References Cited

U.S. PATENT DOCUMENTS

| | | | |
|---|---|---|---|
| 3,146,142 | 8/1964 | Maly | 156/289 X |
| 3,284,761 | 11/1966 | Douglas | 340/10 |
| 3,309,654 | 3/1967 | Miller | 340/10 |
| 3,372,370 | 3/1968 | Cyr | 340/10 |
| 3,460,061 | 8/1969 | Massa | 340/10 X |
| 3,474,403 | 10/1969 | Massa et al. | 340/10 |
| 3,515,910 | 6/1970 | Fritz et al. | 340/10 X |
| 3,539,980 | 11/1973 | Massa | 340/10 X |
| 3,716,828 | 2/1973 | Massa | 340/10 |

*Primary Examiner*—Harold J. Tudor

*Attorney, Agent, or Firm*—Richard S. Sciascia; Ervin F. Johnston; Thomas Glenn Keough

[57] ABSTRACT

A coupling ring is bonded onto the opposite ends of a ferroelectric stack having substantially the same thermal expansion coefficient as the stack. A thin film of silicone compound is wiped onto the axially exposed surfaces of the rings and surfaces provided in a head and a tail mass are configured to mate with them. A plurality of microspheres are mixed uniformly through a liquid adhesive and this mixture is coated onto the suitably shaped surfaces on the head and tail mass. A stress rod reaching between the head and tail mass axially compresses the ferroelectric stack and excess adhesive mixture is squeezed from between the mating surfaces. The thickness of the liquid adhesive is restricted to the diameter of the microspheres to ensure a high impedance match and upon applying the proper amount of heat, rigid joints are set up between the now hardened adhesive and the head and tail mass. Nonrigid joints or radially displaceable are created across the silicone compound films to create an optimum impedance match between the ferroelectric stack and the masses and to prevent the transfer of self-destructive tensile strains as the head and tail masses change dimensions in response to changing ambient temperatures.

4 Claims, 3 Drawing Figures

METHOD AND APPARATUS FOR SECURING A FERROELECTRIC STACK TO A WEIGHTED PROJECTION SURFACE

STATEMENT OF GOVERNMENT INTEREST

The invention descirbed herein may be manufactured and used by or for the Government of the United States of America for governmental purposes without the payment of any royalties thereon or therefor.

This is a division of application Ser. No. 201,706 filed on Nov. 24, 1971 of Jack W. Holloway for METHOD AND APPARATUS FOR SECURING A FERROELECTRIC STACK TO A WEIGHTED PROJECTION SURFACE.

BACKGROUND OF THE INVENTION

Conventionally, transducer designers have used epoxy resin adhesives to join stacks of ferroelectric rings to head and tail masses with the goal of achieving a low-loss coupling between the active element and the radiating surfaces. Better operation characteristics and avoidance of the generation of self-destructive tensile forces have dictated that longitudinal compressional prestressing be included to help the coupling among elements. In addition, it is known that a thin, rigid glue line optimizes the impedance matching across the joints between the active and the passive transducer elements. However, the different thermal expansion coefficients of the dissimilar materials often failed in fluctuating temperatures and demonstrated the unsuitability of the rigid thin-line joints. To elaborate, a rigid thin glue joint between an aluminum head mass and a piezoelectric ceramic stack often tore the stack apart during curing. Since the thermal expansion coefficients of these materials are $23.8\times10^{-6}$ cm/°C. and $3.8\times10^{-6}$ cm/°C. respectively, the elevated curing temperature of epoxy resin adhesives ranging from 150° to 200° F. creates an intolerable stress level. Similarly, self-destructive stress levels are set up when the transducer is operated in a cold ocean environment, for instance, under an ice pack. Unfortunately, the rigid epoxy resin adhesive does not bend or give as the stack and head elements undergo their different ranges of flexure but rather the ferroelectric or ceramic element is torn apart due to its inherent low tensile strength. Furthermore, the brittle ceramic element shatters if the transducer is subjected to shock because the rigid epoxy resin joint transfers all the impact to the fragile element. Another disadvantage of using an epoxy adhesive joint is its permanent nature. For example, when different operating characteristics are desired, it is expedient to change the head and tail mass and the costly ferroelectric stack unavoidably is destroyed as the masses are being removed. One notable attempt at remedying the enumerated shortcomings of a rigid joint employs a rigid fiberous glass-epoxy shim to couple the ferroelectric driving element to the metal head and tail masses. Using stress rods to hold the parts together does provide a decoupling across the joints and does solve thermal expansion problems. The main deficiency of this approach becomes apparent when such a transducer is operated for the joints do not mate intimately and the impedance match, necessary for responsive operation, is lacking.

SUMMARY OF THE INVENTION

The invention is directed to providing a method and means for improving the coupling between a ferroelectric stack and a head and tail mass including a coupler means bonded onto opposite axial extremes of the stack having their axially exposed surfaces wiped with a film of silicone compound possessing the capability for inhibiting bonding. A liquid adhesive is coated onto surfaces shaped to mate with the axially exposed surfaces and the mating surfaces are forcefully brought together by a stress rod reaching between the head and tail masses. After curing, a rigid joint is set up across the hard adhesive where it contacts the head and tail masses while adjacent unbonded joints are created across the silicone compound film to block the transfer of destructive stresses caused by ambient temperature and pressure variations.

It is a prime object of the invention to provide a joint between the dissimilar materials of a transducer maximizing their mutual impedance matching while preventing a transfer of destructive stresses.

Another object is to provide a method for constructing a nonrigid joint for isolating a ferroelectric stack from the dimensional changes of dissimilar materials.

Another object is to provide a method and means for assembling a transducer allowing its subsequent disassembly without damage to its elements.

Yet another object is to provide a method and means for constructing a transducer that is highly resistant to ambient temperature and pressure variations.

Still another object is to provide a method and means for constructing a transducer resistant to shock.

A further object of the invention is to provide a method and means for transducer construction optimizing the internal impedance matching permitting a more responsive projection of acoustic energy.

These and other objects of the invention will become more readily apparent from the drawings when taken with the ensuing specification.

DESCRIPTION OF THE PREFERRED EMBODIMENT

Figure 1:
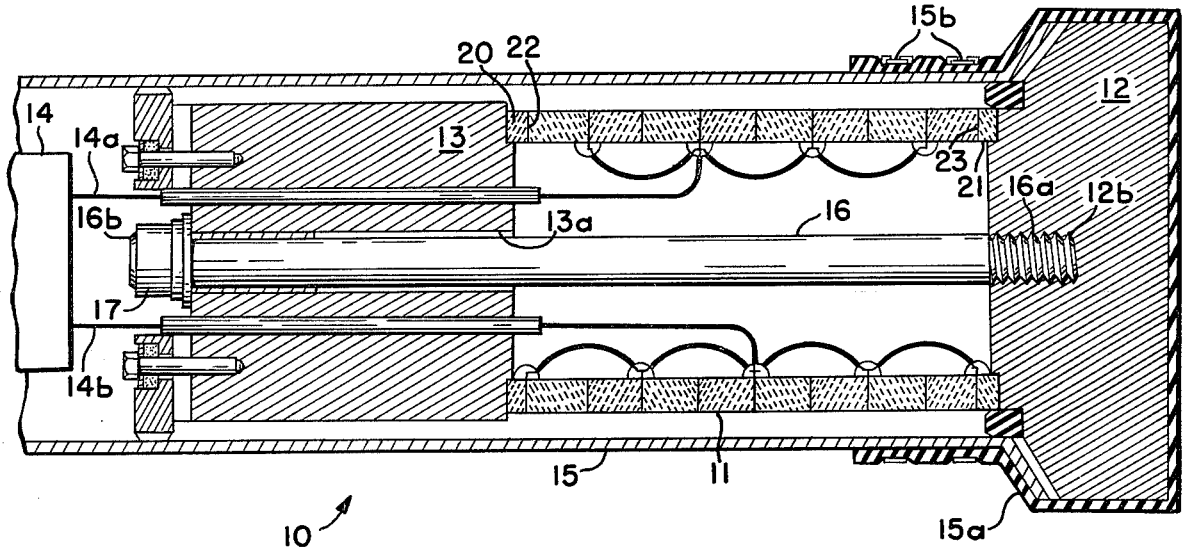
FIG. 1 is a side view, partially in section, of a typical transducer fabricated in accordance with the teachings of the present invention.

Referring now to the drawings, transducer 10 of acoustic energy includes as its active element a ferroelectric stack 11. The stack, fabricated in accordance with well established procedures, consists of a plurality of ringshaped ferroelectric elements, barium titanate for example, sandwiching thin conductors connected electrically in parallel. Since the ferroelectric elements have previously been polarized in their axial direction, signals impressed across the conductors cause a proportional axial deformation and reciprocate the head mass 12. Since an outer surface **12*a*** of the head mass is in contact with the water medium, acoustic energy is projected through the water medium.

A tail mass 13 is carried at the opposite end of the stack to provide a counteractive inertial member for the reciprocating head mass. Suitable driving circuitry 14 coupled to the ferroelectric stack by a pair of leads **14*a* and 14*b* completes the principal components of the transducer. If it is desired to submerge the entire transducer rather than merely placing the outer surface of the head mass in contact with the water, add a housing 15 having a rubber sleeve 15***a* . The sleeve is clamped onto the head mass by a pair of hose clamp like members 15*b* and watertight integrity is ensured.

The structural arrangement described above is a common design of several transducers presently in use. Their ferroelectric stacks are usually directly bonded onto the head and tail masses and because of this fact most of the conventional transducers are not as rugged or reliable as they could be. At the juncture where the rigid bonding joints hold the brittle ferroelectric or ceramic elements to the metal head and tail masses, cracking or breaking often occurs due to the different rates at which the metals and ceramics change their dimensions in response to ambient temperature changes. The rigid joints additionally make the transducers quite vulnerable to external shock and the rapid pressure variations.

The invention partially avoids these problems by including an elongate stress rod 16 threaded at its inner end 16*a* to engage a correspondingly threaded bore 12*b* provided in head mass 12. The rod axially extends the length of the transducer and through a larger diametered bore 13*a* traversing the tail mass. When a nut 17 is tightened on the stress rod, a proportional compressional force is exerted between the head and tail mass on the ferroelectric stack. The stress rod's holding the stack in compression minimizes the possibility of the stack's tearing itself apart as it undergoes violent reciprocal excursions in response to high levels of driving power.

Figure 2:
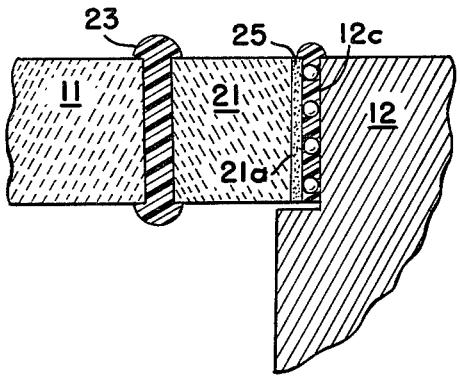
FIG. 2. is an exaggerated blow up of the rigid-radially displaceable joint between a ferroelectric stack and the head mass.

By far, the unique features by which the invention overcomes transducer failure due to varying expansion rates of the transducer elements are owed to the inclusion of two alumina insulator rings 20 and 21 and the manner by which they link the stack to the masses. The rings are each bonded along a rigid joint line 22 and 23 to opposite ends of the ferroelectric stack. In FIG. 2, the joint line 23, as well as the other joints, are shown in a greatly exaggerated scale with respect to the relative sizes of the stack and the head mass for the purpose of explanation only. It is emphasized that the bonds and joints are as thin as possible to ensure acceptable impedance matching among the elements.

The alumina insulator rings are chosen to have as nearly the same density, sound velocity and coefficient of expansion characteristics as does the ferroelectric stack. Partially because of this factor, greatly improved impedance matching results with a resulting distortion-free transfer of mechanical motion to the head mass. Thusly assembled and bonded along joint lines 22 and 23 the stack becomes a unitized element readily removable from the head and tail masses by simply unscrewing nut 17 from stress rod 16.

The superior operating characteristics of the invention are more clearly understood by referring to FIG. 2 and this discussion will restrict itself to the rigid-radially displaceable joints between the stack and the head mass since the joints are identical with respect to the mounting of the tail mass on the stack.

Bonded joint 23 solidly connects alumina insulator ring 21 to the ferroelectric stack. At the opposite side of the insulator ring, on its axially exposed surface 21*a*, the ring is coated with a layer of a silicone compound 25. This silicone compound has the release and anti-friction characteristics of a commercially available type, DC-11. marketed by the Dow Corning Corporation and this type preferably is used in the present application.

After the layer has been applied, the axially exposed surfaces are wiped with a tissue leaving only a thin film of the silicone compound to give the axially exposed surfaces a mirror polished finish. With the thin film in place, the axially exposed surface 21*a* having a grandular "roughness" of 20–25 microinches, becomes unbondable with epoxy adhesives.

Matching or mating surfaces 12*c* and 13*b* are machined in the head mass and tail mass and a quantity of a liquid adhesive 26. This adhesive has the high viscosity and strength of a commercially available model marketed under the trademark Epon VI by the Hysol Division of the Dexter Corporation of Pittsburg, California and is selected for bonding the stack to the head mass.

A preselected amount, approximately 1% of the volume of the liquid adhesive, of hollow silicia microspheres 27 having a particle size of 30 to 125 microns is mixed in with the liquid adhesive to a uniform consistency. A coating of liquid adhesive mixture is applied and adheres to the clean machined area of the matching surfaces. As the coated mixture starts to set yet still remains fluid, axially exposed surface 21*a* is forcefully brought against matching surface 12*c* by tightening nut 17 on threaded stress rod 16.

By an appropriate guage, the magnitude of the compressional force exerted by the rod is set at 3000 PSI. Upon approaching this magnitude, excess adhesive and microspheres are extruded from between the stack and the head mass until axial exposed surface 21*a* and the matching surface 12*c* come in contact with microspheres 27 mixed throughout liquid adhesive 26. As forceful contact is made with the spheres, the spheres prevent additional axial travel and a thin layer of the adhesive mixture remains. Since there is only a 1% volume of spheres, at least 99% of the opposed surfaces are in contact with the adhesive to allow uniform complete adhesion across the surfaces. This narrow line joint, its width regulated by the diameter of the microspheres, improves the coupling between the ferroelectric stack and the head mass to near optimum levels. Since, like the alumina insulator ring, the liquid adhesive also possesses density, sound velocity and coefficient of expansion characteristics substantially identical to those of the ferroelectric stack, superior impedance matching is ensured.

To properly harden the adhesive mixture, a curing process is necessitated. The curing process calls for maintaining the still plastic liquid adhesive between the ferroelectric stack and the head and tail mass at the 3000 PSI pressure. While this compressional force is maintained, the joint is heated to a temperature between 150°–200° F. This temperature is maintained for several hours to permit the proper setting of the selected liquid adhesive. During this time, there must be no mixing of the silicone compound with the adhesive. For this reason DC-11 silicone compound is chosen since it has a high temperature non-melt and flow characteristics.

It is quite obvious that during the curing time when the temperature is raised, the metal head and tail masses expand greater distances than the ferroelectric stack. Heretofore a goodly number of rigid joint transducers were broken during the curing process.

In the present invention, after the liquid adhesive has hardened, a rigid joint is formed across the hardened adhesive with the head mass. However, since the silicone compound creates an unbondable surface on the surface of the alumina insulator ring, an adjacent, unbonded joint is created through which axially excursions of the ferroelectric stack are transmitted to the head and the tail mass. By having a nonrigid joint across the film of silicone compound relative lateral motion is allowed between the masses and the stack and tensile stresses are not transferred to the stack. Similarly when the transducer is operated under adverse conditions, for instance at freezing and subfreezing temperatures, the nonrigid joint across the silicone compound allows for the relative greater lateral contraction of the metal head and tail means preventing internal tensile stresses from tearing the stack apart. Furthermore, should the stack be subjected to shock, a certain amount of give is incorporated across the stack-mass interface to help absorb the otherwise damaging shocks.

Figure 3:
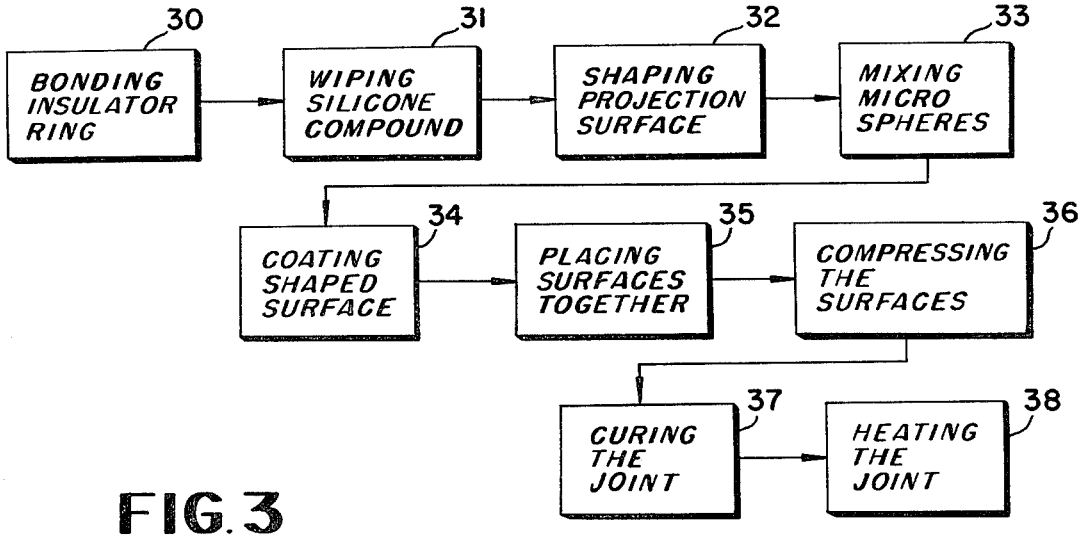
FIG. 3 is a block flow diagram outlining the method of constructing the transducer.

Additional insight to the construction of the aforedescribed improved coupling is gleaned from FIG. 3 showing schematically the process by which the improved coupling is constructed. Firstly, there is the bonding 30 of the alumina insulator ring onto opposite ends of the ferroelectric stack and the wiping 31 of a thin film of silicone compound onto the exposed axial surface of each ring. Shaping 32 a mating surface on the projector to correspond with the exposed axial surface readies the transducer for further processing. Mixing 33 a plurality of microspheres and coating 34 the shaped surface sets the stage for final assembly of the transducer according to the teachings of the invention.

Placing 35 the shaped area against the exposed axial surface and compressing 36 the two surfaces together by the mechanical coaction of the nut and stress rod limits the amount of adhesive mixture extruded from between the two converging surfaces. After the surfaces have been compressed together, a curing 37 operation begins which in its simpliest form, is no more than allowing a sufficient period of time to elapse to permit the adhesive to change from a liquid state to a solid state. Preferably, the curing calls for heating 38 the joint to a temperature of between 150° F. and 200° F. for proper setting to ensure optimum impedance match within the transducer elements.

Obviously, many modifications and variations of the present invention are possible in the light of the above teachings, and, it is therefore understood that within the scope of the disclosed inventive concept, the invention may be practiced otherwise than specifically described.

What is claimed is:

1. A method for securing a ferroelectric stack to a weighted projection surface having a given coefficient of thermal expansion comprising:

bonding a coupler ring onto an axial projection of said stack said ring having an exposed axial surface and having nearly the same coefficient of thermal expansion as said stack but different from said weighted projection surface;

wiping a thin film of silicone compound onto the exposed axial surface of said ring to provide a bonding inhibiting surface;

shaping an area of said projection surface to mate with said exposed axial surface;

coating the shaped area with a liquid adhesive;

placing said shaped area against the bonding inhibiting exposed axial surface while said liquid adhesive is fluid; and heating the fluid adhesive for a time to harden it to form a rigid joint with said shaped area and a radially slideable joint with said thin film to mechanically decouple said stack from the differing magnitudes of thermal expansion of said weighted projection surface while maintaining a high impedance match across both joints.

2. A method according to claim 1 amended further including:

exerting a compressional force between said exposed axial surface and said shaped area squeezing out excess said liquid adhesive to ensure the creation of a thin line rigid joint.

3. A method according to claim 2 further including:

mixing a plurality of hollow microspheres in said liquid adhesive prior to curing, upon exerting said compressional force, said microspheres limit the width of the thin line joint to the thickesss of a single layer of said microspheres for further ensuring said impedance match.

4. A method according to claim 3 in which said heating includes bringing the ambient temperature to a level in excess of 150° F. and said compressional force is in excess of 1000 PSI.

* * * * *